United States Patent [19]

Jones et al.

[11] 4,057,887

[45] Nov. 15, 1977

[54] PIPE DISCONNECTING APPARATUS

[75] Inventors: Marvin R. Jones; Paul E. Helfer, both of Houston, Tex.

[73] Assignee: Cameron Iron Works, Inc., Houston, Tex.

[21] Appl. No.: 646,247

[22] Filed: Jan. 2, 1976

Related U.S. Application Data

[62] Division of Ser. No. 467,158, May 6, 1974, Pat. No. 3,957,113.

[51] Int. Cl.[2] ..... B25B 17/00

[52] U.S. Cl. ..... 29/240; 81/57.16; 81/57.18; 81/57.19; 81/57.21; 81/57.34

[58] Field of Search ..... 81/57.15–57.22, 81/57.33, 57.34, 57.35, 57.39, 57.46, 54; 166/77.5; 24/263 DH, 263 DB, 263 A; 29/240

[56] References Cited

U.S. PATENT DOCUMENTS

| | | | |
|---|---|---|---|
| 2,419,711 | 4/1947 | Dillon | 24/263 DB |
| 2,542,302 | 2/1951 | Barker | 24/263 DB |
| 3,666,026 | 5/1972 | Allard | 81/57.17 |

*Primary Examiner*—James L. Jones, Jr.

[57] ABSTRACT

Apparatus for disconnecting the lower threaded end of an upper section from the upper threaded end of a lower section of pipe string extending through the bore of an underwater wellhead.

41 Claims, 12 Drawing Figures

PIPE DISCONNECTING APPARATUS

This is a division of patent application Ser. No. 467,158, filed May 6, 1974 now U.S. Pat. No. 3,957,113 entitled PIPE DISCONNECTING APPARATUS.

This invention relates to apparatus for disconnecting pipe sections which are disposed at a relatively remote location. More particularly, this invention relates to improvements in apparatus for disconnecting an upper from a lower section of a pipe string extending within the bore of an underwater wellhead. In one of its aspects, this invention relates to improvements in apparatus of this type which also contains the pressure within the well, both prior and subsequent to the disconnection of the upper and lower sections of the pipe string.

In the drilling of underwater wells, weather conditions may require that an upper section of a pipe string, such as a string of drill pipe to which a drill bit is connected, be disconnected from its lower section to permit it to be removed with a drilling vessel from which the string is suspended. More particularly, it is necesary to disconnect the string at the level of the blowout preventer stack of the wellhead, so that, when it is disconnected, the bore through the wellhead may be closed by rams of a preventer in the stack. This, however, cannot be done by the usual equipment on a drilling vessel, because it is impossible to predict which joint of the string will be "backed off." Also, time does not permit the string to be raised and disconnected, stand by stand, as is done in the ordinary drilling procedure.

It has therefore been proposed to shear the drill string by means of one or more blades mounted for reciprocation within guideways extending outwardly from the bore through the wellhead. More particularly, a pair of blades are preferably mounted on "blind" rams of a blowout preventer, which have seal portions arranged to seal off with one another and with respect to the guideway, when the drill pipe has been sheared and its sheared ends are moved to positions out of the way of the inner ends of the rams. Thus, these rams serve to close off the well bore, either when there is no pipe in the bore or following shearing of the drill string.

Ordinarily, such a preventer also includes "pipe" rams mounted for reciprocation in guideways beneath the blind rams and adapted to close off the bore about the lower section of the drill string, either before or after it has been sheared. In order to avoid attempting to shear the string at a tool joint, it is the preferred practice, in preparing to use apparatus of this type to shear a drill string, to lift the string, move the pipe rams inwardly about the string, and then lower the string to permit the lower end of the tool joint immediately above the pipe rams to seat on their upper surfaces.

This practice of shearing the drill string presents problems when drilling of the well is to be resumed. For one thing, small pieces of the drill string may break off from it adjacent its sheared edges, thereby leaving "junk" in the hole. Also, in reentering the well, it's necessary to perform complicated and time-consuming milling and fishing operations to prepare the cut edges of the upper end of the lower section to receive an upper extension thereof.

An object of this invention is to provide apparatus which permits the upper section of the pipe string to be disconnected from the lower section at the level of the wellhead, without the problems encountered with the above-described prior apparatus and thus without the risk of junking the hole or the necessity for preparing the cut edges of the upper end of the lower section of the drill string.

Another object is to provide such apparatus which, similarly to the prior apparatus above described, contains the pressure within the well both prior and subsequent to the disconnection of the sections of the drill string.

A further object is to provide such apparatus which is relatively inexpensive to manufacture and easy to operate.

These and other objects are accomplished, in accordance with the illustrated embodiment of this invention, by apparatus which is adapted to disconnect the upper pipe section from the lower pipe section by backing off the lower threaded end of the upper section from the upper threaded end of the lower section at the desired joint between them. For this purpose, it comprises a housing which is adapted to be connected as a part of the wellhead, with its bore aligned with the bore of the wellhead to receive the pipe string, and which has at least one guideway extending outwardly from the bore to receive a ram for movement toward and away from the bore. In accordance with the present invention, the drill string is supported and held against rotation with the lower threaded end of its upper section opposite the ram guideway, and the ram is provided with means arranged to grippingly engage and move along a side of the upper section, and thereby exert a force thereon tending to rotate it about its axis, as the ram is moved in one direction.

Preferably, the housing has oppositely disposed guideways extending from its bore, each for receiving a ram of the type described. This not only multiplies the force with which the upper section is caused to rotate, but also enables each ram to act as a back-up for the side of the pipe section opposite that engaged by the other ram, thereby preventing bending of the unsupported upper end of the lower pipe section. Furthermore, and as will be described below, the lower pipe section is preferably held by means disposed a short distance beneath the ram guideways.

Each ram includes a carrier guidably movable in the guideway, and a jaw mounted on the carrier for longitudinal movement with it toward and away from the bore of the housing. The jaw has a cam surface which is slidable over a cam surface on the carrier, and a toothed surface which is arranged to be wedged by the cam surfaces into gripping engagement with and movement along the side of the upper pipe section, as the carrier moves in one longitudinal direction. Preferably, a spring engages the jaw and carrier to yieldably urge the jaw into a position in which its toothed surface is so arranged.

The drill pipe sections making up a drill string are connected by tool joints whose threads are held with a compressive force which is substantially relieved by rotating one end only a fraction of a revolution with respect to the other. Thus, only one traverse of the rams may be required to back the upper drill pipe section off from the lower drill pipe section a sufficient extent to permit their complete disconnection and separation by means on the drilling vessel. In any event, however, the jaw surfaces are so arranged that, upon movement of the rams in the opposite direction, the toothed surfaces are relieved from gripping engagement with the upper section, whereby the carrier may be returned to a position from which it may again be moved for exerting force on the upper pipe section. Consequently, in the event further backing off is required to permit the upper section to be completely disconnected from the lower section by means of pipe tongs, the rams may be moved through one or more additional traverses. Also, when returned to such position, the rams may also be used in backing off the upper sections of other pipe strings which might later be lowered into the well bore.

Preferably, the toothed surface on the jaw of each ram extends at an angle to the direction of movement of the carrier, so that it is free to move along the side surfaces of a wide range of pipe diameters as the cam surface on the jaw slides over the cam surface on the ram. After the jaw has so moved and the carrier is retracted to permit the gripping engagement of the toothed surface of the jaw to be relieved, the jaw is preferably returned to its original position on the carrier by the abovedescribed spring engaging the jaw and carrier. Also, in order to eliminate most of the side thrust on the carrier, and thereby minimize frictional resistance to sliding of the carrier within its guideway, the cam surfaces on the jaw and carrier may extend at an angle to a transverse plane approximately equal to the friction angle between them.

The means by which the lower pipe section is held preferably comprises additional rams guidably slidable within additional guideways extending outwardly from the housing bore, beneath the above-mentioned guideways, each additional ram having a recess on its inner end to fit tightly about and support the lower pipe section. Preferably, each such pipe ram also includes means for sealing about the lower pipe section, with another pipe ram, and with its guideway, so as to close off the bore through the housing, and thus within the wellhead, about such lower section of pipe. Preferably, the housing also has further guideways extending outwardly from its bore, above the first-mentioned guideways, each for receiving a further ram guidably slidable therein and having means for sealing with another further ram and the guideway in which it's slidable, whereby these "blind" rams permit the bore through the wellhead to be closed off above the upper end of the lower pipe section. Such blind rams may, of course, be provided with shear means, such as shown, for example, in U.S. Pat. No. 3,817,326.

In the use of the present apparatus in disconnecting sections of a drill string, a strain is taken on the string, and the pipe rams are moved inwardly to fit thereabout beneath a tool joint between upper and lower sections. The strain is then relieved to permit the lower section to be supported by the engagement of the lower end of the lower tool joint upon each of the pipe rams, and thus with the upper end of the tool joint on the upper pipe section opposite the back-off rams. Furthermore, the guideways for the back-off and blind rams are circumferentially offset and vertically spaced from one another a minimum distance, so that the housing of the present apparatus requires a minimum of head room. In fact, the height of the housing may be less than that of the housing of the above-described prior apparatus, which must be high enough to position its shear rams on a level above a tool joint supported on pipe rams beneath it.

Depending on the length of the drill string, its weight may be found sufficient, when supported by the pipe rams, to prevent the lower section from rotating as the upper section is backed off from it. However, if additional resistance to rotation is required, it is provided by means of gripping means about the recess of one or more of the pipe rams for resisting such rotation. In one embodiment, the upper end of the recess is conically shaped, and the gripping means comprises substantially vertically extending teeth formed on the conically shaped end. In another embodiment, the gripping means comprises a one-way clutch carried by the ram body adjacent the recess.

Figure 2:
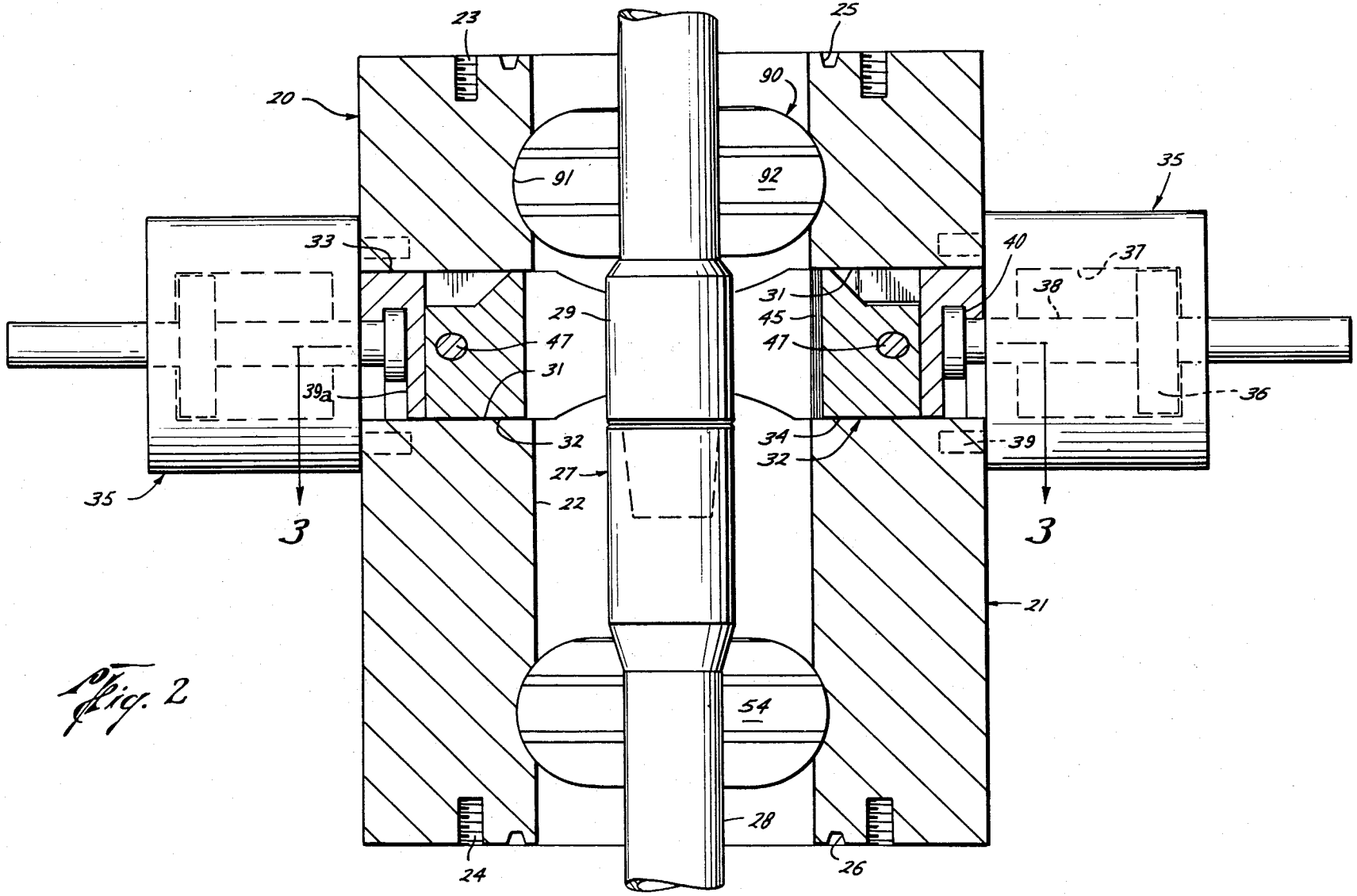
FIG. 2 is another vertical sectional view of the apparatus, as seen along broken line 2—2 of FIG. 1.
Figure 3:
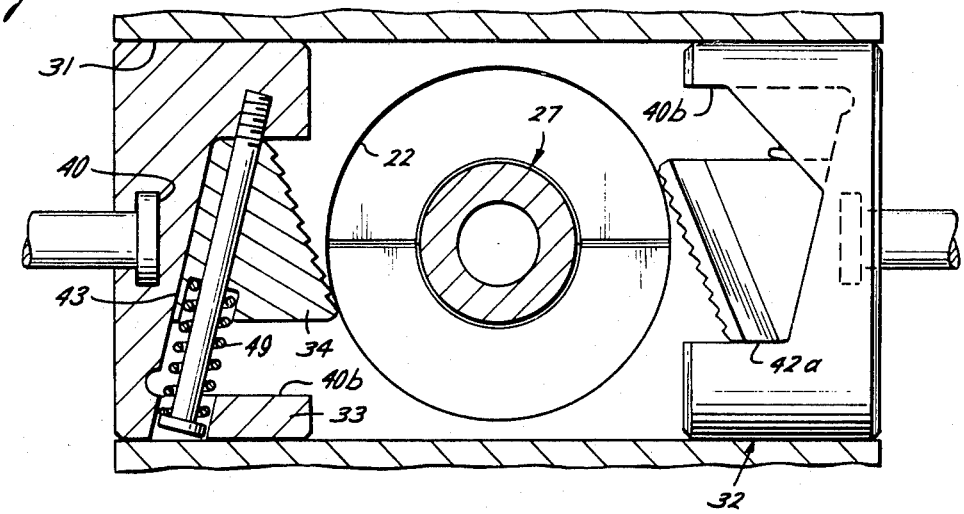
Figure 4:
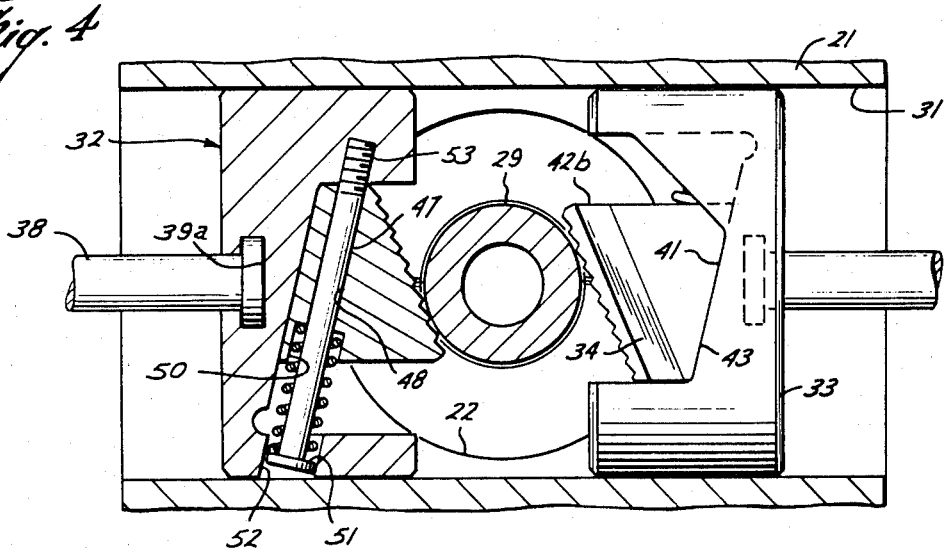
Figure 5:
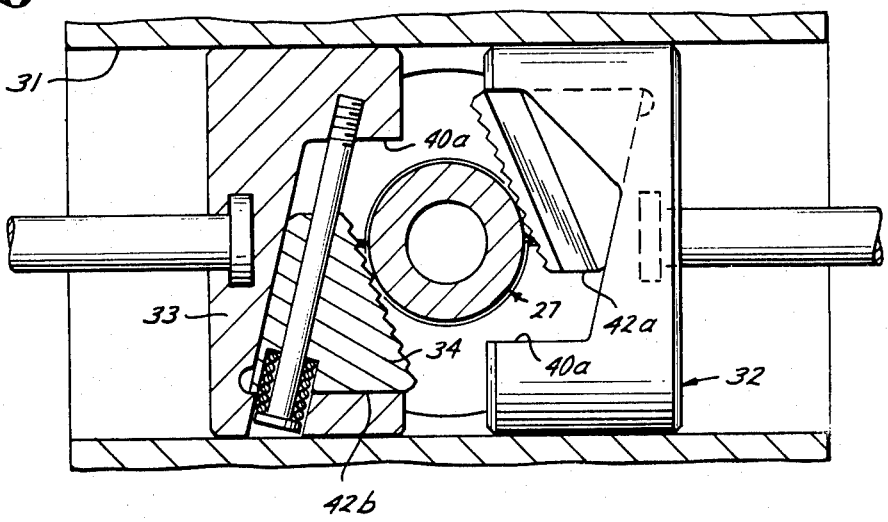
Figure 6:
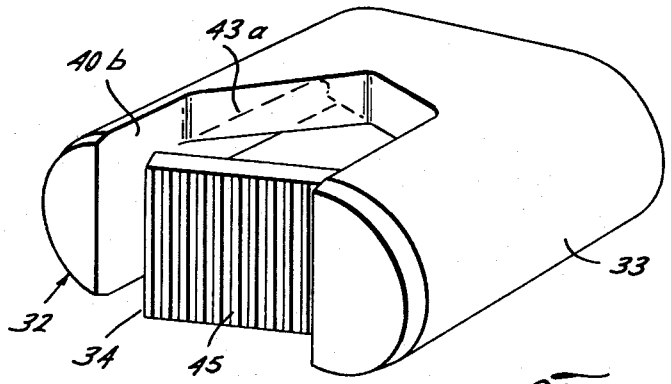
Figure 7:
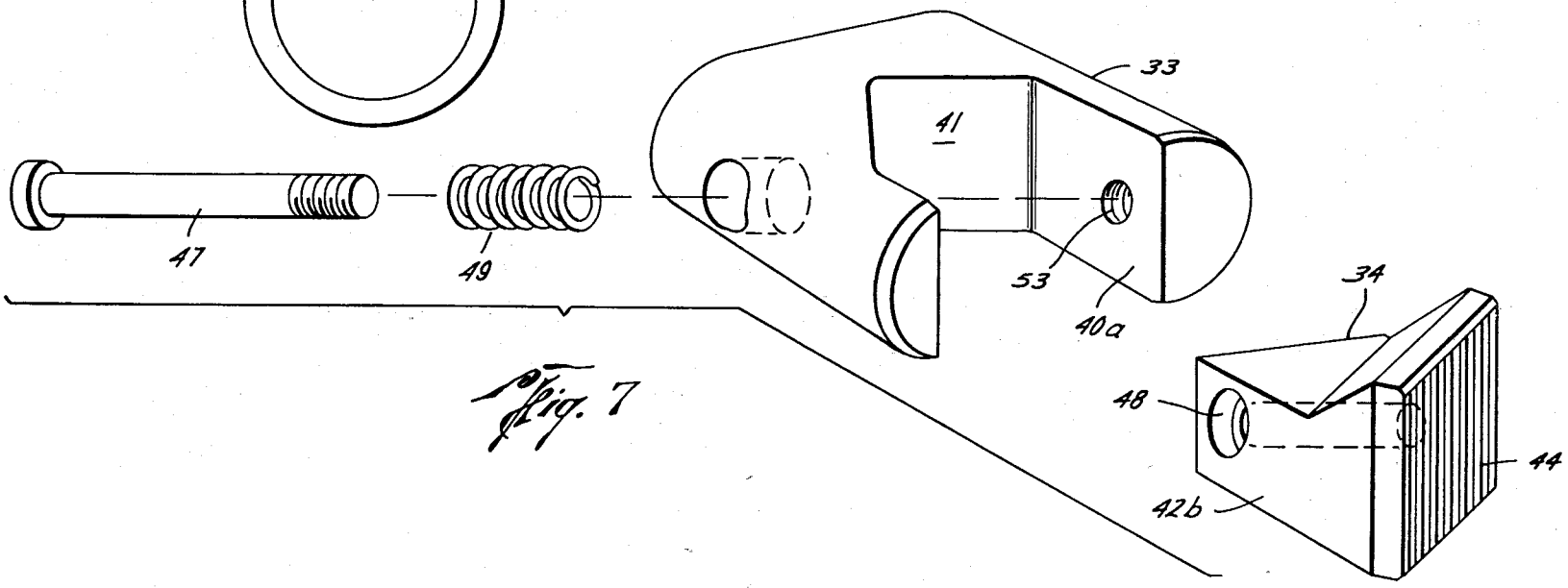
Figure 12:
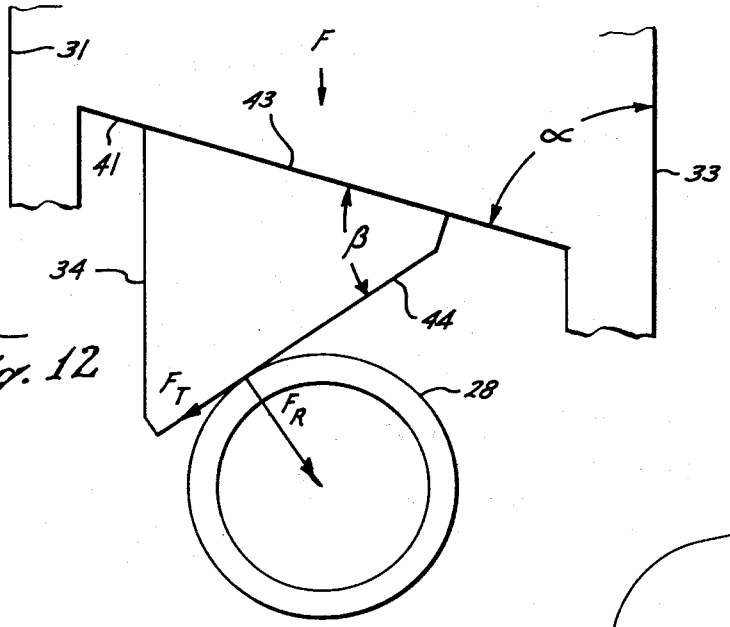
Figure 8:
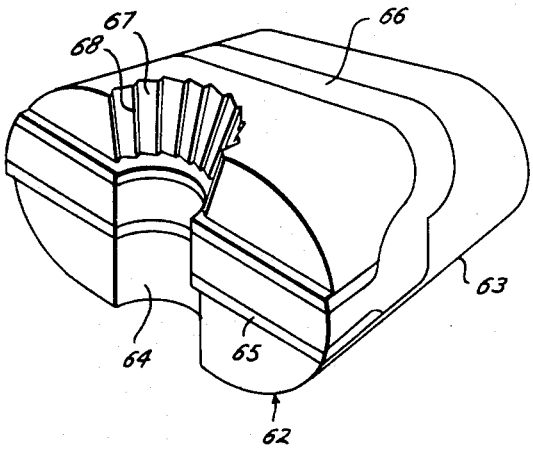
Figure 9:
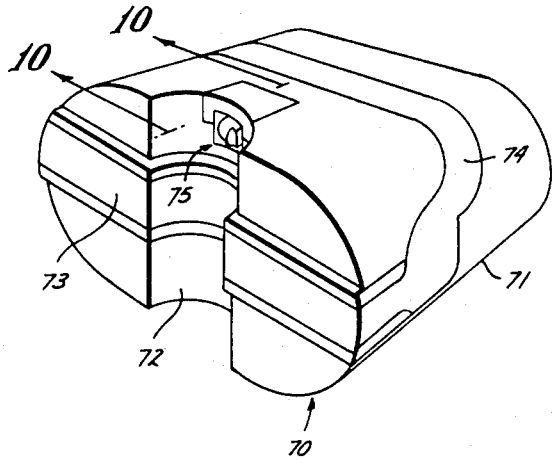
Figure 10:
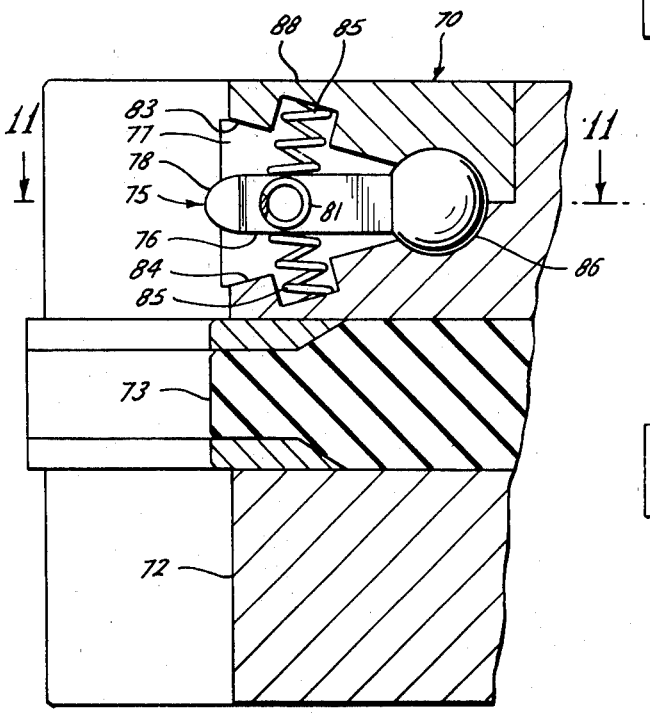
Figure 11:
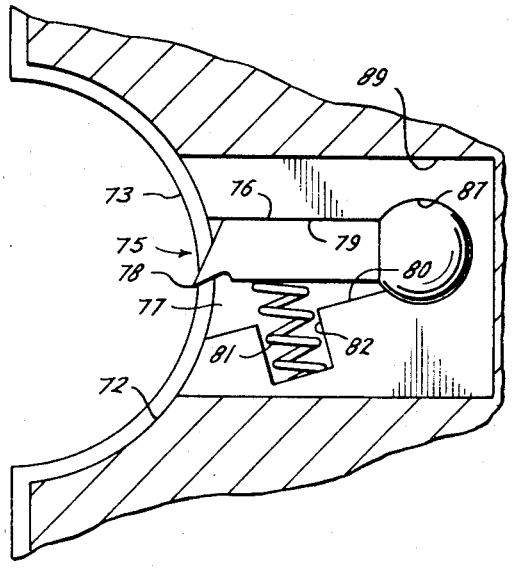

FIGS. 3, 4 and 5 are horizontal sectional views of a portion of the apparatus, as seen along broken line 3—3 of FIG. 2, with the back-off rams thereof shown in FIG. 3 in the positions they occupy prior to movement into engagement with the pipe string, in FIG. 4 in the positions they occupy as they first engage the pipe string, and in FIG. 5 in the positions they occupy after they have moved along opposite sides of the upper section of the pipe string, so as to rotate it with respect to the lower section thereof;

FIG. 6 is an isometric view of one of the back-off rams removed from its guideway, and as seen from the top, front and one side thereof;

FIG. 7 is an exploded, isometric view of the back-off ram, as seen from the top, one side, and other side thereof;

FIG. 8 is an isometric view of an alternative embodiment of a pipe ram, removed from its guideway;

FIG. 9 is an isometric view of another alternative embodiment of a pipe ram, also removed from its guideway;

FIG. 10 is an enlarged vertical sectional view of a part of the pipe ram of FIG. 9, as seen along broken lines 10—10 of FIG. 9;

FIG. 11 is a horizontal sectional view of the part of the pipe ram shown in FIG. 10, as seen along broken lines 11—11 of FIG. 10; and FIG. 12 is a diagrammatic illustration of the forces which cause a pipe section to rotate.

Figure 1:
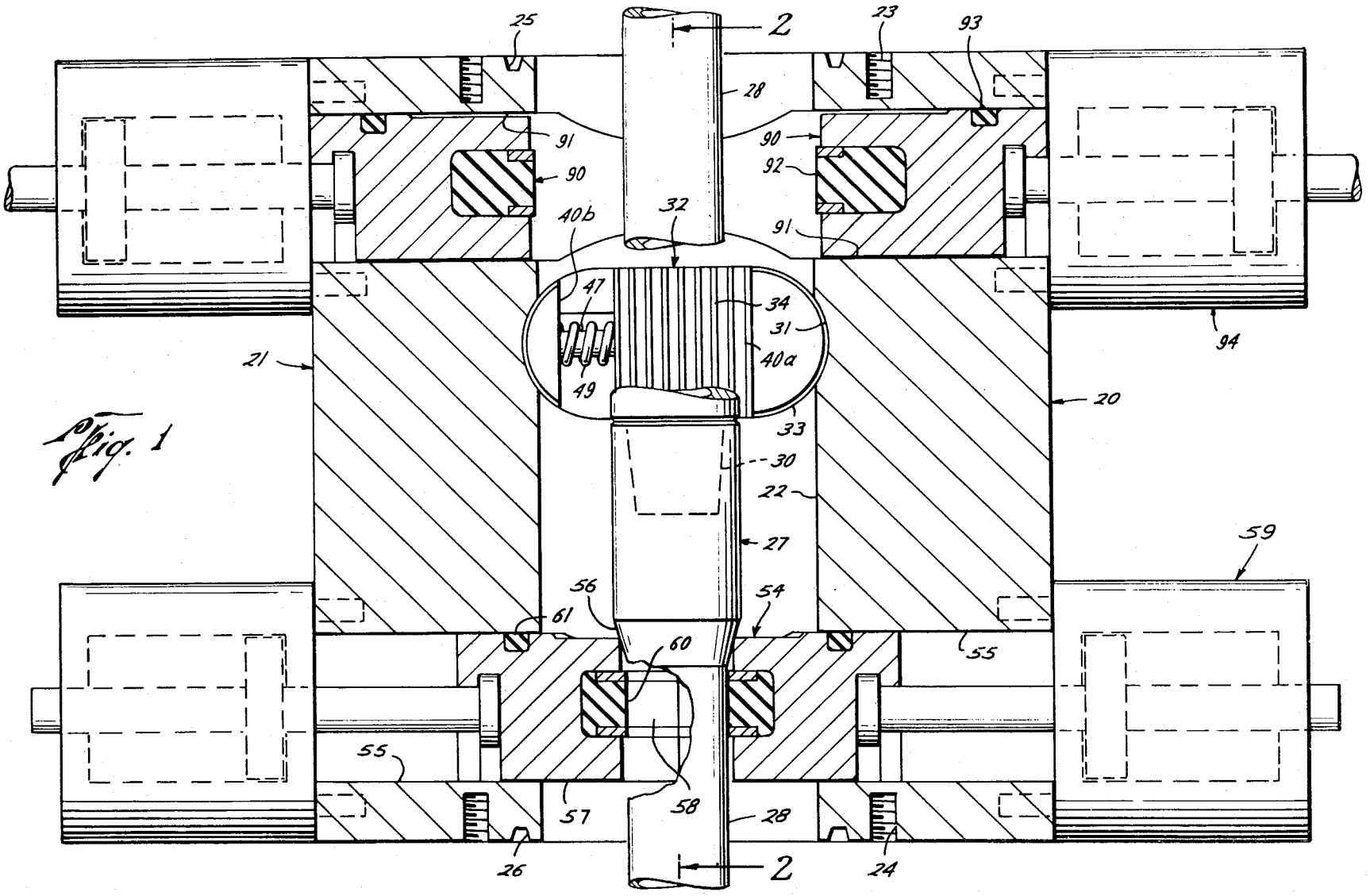
FIG. 1 is a vertical sectional view of apparatus constructed in accordance with this invention, and showing a drill string supported within the bore through the housing thereof.

With reference now to the details of the above-described drawings, the overall apparatus, which is indicated in its entirety by reference character 20, is shown in FIGS. 1 and 2 to comprise a housing 21 having a bore 22 extending vertically therethrough and adapted to be connected as a part of an underwater wellhead, with its bore aligned with the bore of the wellhead. For this latter purpose, the upper and lower ends of housing 21 are provided with circles of threaded holes 23 and 24, respectively, for receiving studs connecting them to adjacent ends of parts of the wellhead above and below the housing. Also, there are ring grooves 25 and 26 in the upper and lower ends of the housing, respectively, within the circle of threaded holes, for receiving seal rings for sealing between them and matching grooves in the ends of the other wellhead parts.

As well known in the art, during drilling of the well, a drill string 27 extends downwardly from a drilling vessel from which it is suspended at its upper end through the bore of the wellhead and into the well bore therebelow. Thus, in accordance with conventional drilling practices, the drill string is rotated by suitable equipment on the vessel to cause a bit at its lower end to drill out a formation at the lower end of the well bore. With the benefit of modern techniques, the well may be drilled in water several hundred feet deep, so that, with the wellhead located at the underwater surface, there may be several hundred feet of drill string extending between the wellhead and the drilling vessel.

As shown in FIGS. 1 and 2, drill string 27 is made up of section 28 of drill pipe whose opposite ends are threadedly connected by tool joints 29. A typical tool joint comprises an enlarged box member having female threads for receiving the male threads of a pin member 30, the box being formed on the lower pipe section and the pin on the upper pipe section. As well known in the art, the threads of the two ends of the tool joint are made up until their end faces are brought into tight, sealing engagement with one another. As also well known in the art, this tight engagement, and thus the torque to which the tool joint is made up, is substantially relieved in response to only a fraction of a turn of one end with respect to the other, so that although the torque to which the joint is still made up may be sufficient to prevent its being disconnected by hand, it nevertheless is sufficiently less than that to which the other joints of the string are made up, that it may be completely disconnected by means on the vessel.

As shown in each of FIGS. 1 and 2, a pair of guideways 31 extend outwardly from opposite sides of an intermediate portion of the bore 22 of the housing 21. A back-off ram 32 received within each guideway comprises a carrier 33 guidably slidable in a longitudinal direction within the guideway toward and away from the bore, and a jaw 34 mounted on the carrier for longitudinal movement with it. The carrier, and thus the jaw, of each ram is moved toward and away from the bore by means of an operator 35 mounted on the outer side of the housing 21 and comprising a piston 36 reciprocal within a cylinder 37 and connected to the rear end of the carrier by means of a rod 38. As well known in the art, the piston and thus the ram are caused to move in opposite directions in response to suitable fluid controls connecting with the cylinder on opposite sides of the piston. As shown in FIG. 2, each guideway 31 extends from the bore of the housing to the outer side of the housing so as to permit the ram to be moved into and out of the guideway through its outer end. The operator may be releasably connected to the housing across the outer end of the guideway in any conventional manner, such as by means of studs 39 (see FIG. 2).

As previously described, and as shown in FIGS. 1 and 2, the drill pipe is adapted to be supported in the bore of the housing with the upper end of the tool joint 29 on the lower end of the upper pipe section opposite the back-off rams 32. Thus, with the lower pipe section held against rotation, the rams may be moved inwardly from the positions shown in FIG. 2 so as to cause the faces of their jaws to grippingly engage and move along a side of the upper pipe section, as best shown in FIGS. 4 and 5, and thus exert a force thereon tending to rotate such upper pipe section about its axis. More particularly, and as will be apparent from FIGS. 4 and 5, the jaw faces are engageable with diametrically opposite sides of the upper pipe section, whereby the rams exert a couple on the pipe. Then, upon completion of their inward stroke (FIG. 5), the rams may be withdrawn to the position of FIG. 3, at which time they are in a position for another traverse, if required, in order to back the upper section off a further amount with respect to the lower pipe section, or to back off the pipe section of another pipe string disposed within the bore of the wellhead housing.

The carrier 33 of each ram 32 comprises a body having a transverse cross section for fitting closely within the guideway 31, a rearward end with a T-slot 39*a* therein for releasable connection to a "T" 40 on the inner end of piston rod 38, and an inner end which is recessed to receive the jaw 34. As shown, the recess on the inner end of each carrier is defined between parallel, vertical side walls 40*a* and 40*b* and a vertical rear wall 41 extending at an angle with respect to the side walls. More particularly, the side walls extend perpendicularly to the top and bottom of the carrier body and parallel to the direction of movement of the ram.

As shown, the jaw of each ram comprises a body which is narrower, from side to side, than the recess in which it is received, so that the jaw body is free to move laterally within the recess, and thus with respect to the carrier, for reasons to be described. Thus, the jaw is movable from one limited position in which its side wall 42*a* is adjacent the side wall 40*a* of the carrier recess (FIGS. 1, 3 and 4), to another limited position in which its side wall 42*b* is adjacent the side wall 40*b* of such recess (FIG. 5). As shown, the side walls of the jaw body are parallel to the side walls of the carrier recess against which they are engageable.

The rear end 43 of each jaw is flat and extends at an angle with respect to its side walls which is equal to the angle at which the end wall 41 of the carrier recess extends with respect to its side walls. More particularly, the end wall 43 extends perpendicularly to its top and bottom and parallel to the recess end wall 41 so that it slides thereacross from one limited position to another. As best shown in FIGS. 6 and 7, the outer or rear end of each jaw 34 is of reduced height and fits beneath a ledge 43*a* which extends across the deeper corner of the carrier recess, to strengthen the thinner side of the carrier. The inner end of the jaw, on the other hand, has an upwardly extending portion which provides it with a front face 44 of substantially the same height as the carrier 33. More particularly, and as best shown in FIGS. 6 and 7, teeth 45 extend vertically over the entire width of the front face, and thus in a direction parallel to the axis of the pipe with which the jaw is engageable, so that movement of the jaw along the side of the pipe will cause the teeth to bite into and turn the pipe about its axis.

As shown, the toothed face 44 of each jaw extends at an angle with respect to the surface on its rear wall 43 so as to be wedged against the upper pipe section as the carrier moves it into engagement with the pipe section. Moreover, continued movement of the carrier inwardly from the position of FIG. 4 toward the position of FIG. 5 will continue to wedge the toothed surface against the pipe, causing its teeth 45 to bite into the pipe, and then move along the side thereof as succesive teeth 45 bite into successive portions of the side of the pipe as the jaw moves laterally across the carrier during continued inward movement of the latter. As previously mentioned, and as will be understood in view of the drawings, the rams are adaptable to enage and move along pipe sections of a wide range of diameters.

Each ram is retained on and mounted for guided movement across its carrier by means of a rod 47 mounted on and extending across the recess of each carrier and through a hole 48 extending through the body of the jaw. More particularly, the rod extends parallel to the cam surface 43 on end wall 41 of the recess, and the hole 48 through the jaw fits relatively loosely about the rod 47 so that the cam surface on the carrier can bear against the cam surface on the jaw as the jaw moves with respect to the carrier.

The jaw of each ram is yieldably urged to the limited position shown in each of FIGS. 1, 3 and 4 by means of a coil spring 49 surrounding the rod 47 between a rod head 51 and the jaw. Consequently, when the rams are withdrawn to the position shown in FIG. 3, the laws are caused to assume positions in which their sides 42*a* engage the sides 40*a* of the carrier recess. Moreover, the jaws are maintained by th springs 49 in this position until they grippingly engage and begin to move along the sides of the pipe section, as illustrated in FIGS. 4 and 5. Then, as the rams move along the sides of the pipe, in response to inward movement of the carriers, they move against the force of the spring toward the limited positions in which their sides 42*b* engage the side walls 40*b* of the recesses. To permit this extent of lateral movement, the ends of the springs 49 engage the end of a counterbore 50 in the hole 48 in each jaw and the enlarged head 51 on the rod 47 disposed within a hole 52 through a side of the carrier adjacent its side wall 40*b*. More particularly, the end of the rod 47 opposite its enlarged head 51 is threaded at 53 for connection to a threaded socket in the side of the carrier adjacent the side wall 40*a* of its recess.

A brief study of the diagram of FIG. 12 will be helpful in understanding the relationships of the carrier 33 and jaw 34 of each back-off ram to one another as well as to the guideway 31 in which the carrier slides and the pipe section 28 to be backed off, and thus the different shapes and configurations which the carrier and jaw may assume in other less preferred embodiments of this invention. Thus, as indicated in FIG. 12:

- $\alpha$ is the angle between the cam surfaces on the carrier and jaw and the guideway 31 (and thus the sides of the carrier slidable therein);
- $\beta$ is the angle between the cam surfaces and the toothed surface of the jaw;
- $\phi$ is the friction angle between the cam surfaces on the carrier and the jaw;
- F is the net driving force on the carrier;
- $F_T$ and $F_R$ are the tangential and radial forces; respectively, with which jaw 34 engages the tool joint; and
- R is the outside diameter of the tool joint.

Then, in close approximation:

$$F_T = F\,[\cos\phi \sin(\beta - \phi)/\sin(\alpha + k\,\phi)]$$

$$F_R = F\,[\cos\phi \cos(\beta - \phi)/\sin(\alpha + k\,\phi)]$$

where $k = 2$, for $\alpha \leqq 90 - \phi$ $k = 0$, for $\alpha \geqq 90 - \phi$.

It follows that the torque applied to loosen the joint is:

$$T = RF_T.$$

In order to avoid broaching by slippage of the jaw across the joint, the ratio $F_R/F_T = \cot(\beta - \phi)$ must be greater when the surface of the joint is harder.

In actual practice, in unscrewing drill pipe tool joints, good results have been obtained with the values $\alpha = 75°$, $\beta = 45°$ and $\phi = 15°$, as illustrated in the drawings. Preferably, $90° \leqq (\alpha + \beta) \leqq 180°$.

As shown in FIGS. 1 and 2, the lower end of the tool joint 29 is supported on pipe rams 54 guidably slidable within guideways 55 extending outwardly from the bore 22 of the housing 21 benath the above-described back-off rams. More particularly, and as previously described, the guideways 55 are spaced below the back-off rams a distance such that the upper section of the tool joint will be disposed opposite the back-off rams when a shoulder 56 on the lower end of the lower section of the tool joint is seated on the top of each pipe ram. As best shown in FIG. 1, each such pipe ram comprises a body 57 shaped in cross section for fitting closely within the guideway 55 and having a recess 58 across its inner end for fitting closely about the drill pipe section 28 beneath the tool joint shoulder 56. When the pipe rams are moved inwardly to the position shown in FIG. 2, they are not only positioned to provide a seat for the shoulder 56, but also to prevent substantial lateral movement of the unsupported portion of the upper pipe section above them. As well known in the art, the pipe rams are moved inwardly and outwardly toward and away from the bore by means of operators 59, which may be similar to the operators 35.

As also shown in FIG. 2, seal means are carried by the body of each pipe ram for sealing about the portion of lower pipe section 28 disposed within its recess, with the seal means of the other pipe ram, and with the guideway 55 in which the pipe ram is disposed, whereby, with the pipe rams moved to the position of FIG. 1, the bore 22 about the lower pipe section is closed off. For this purpose, the particular rams illustrated in FIG. 2 include a seal portion 60 disposed transversely across the inner end of the ram body, including the recess 58, and a seal portion 61 which extends across the top of the ram body and connects along its sides with the opposite ends of the seal portion 60, in a manner well known in the art.

As previously described, it may be found that the weight of the drill string on the pipe rams 54 will be sufficient to prevent the lower section of the drill string from rotating with the upper section. However, if this does not provide sufficient resistance to rotation, the pipe rams 54, which are of conventional construction, may be replaced with alternative pipe rams having means for gripping the lower pipe section to prevent its rotation. One such alternative pipe ram, which is shown in FIG. 8 and designated in its entirety by reference character 62, comprises a body 63 of generally the same shape and size as the body of the ram 54. Similarly to the ram 54, the body of ram 62 has a recess 64 in its inner end for fitting about a pipe section and carries seal means thereon which includes a portion 65 extending across its inner end, and thus across the recess 64, and a portion 66 connected to and cooperating with portion 65 in the manner previously described in connection with the seal means of ram 54. However, the upper end 67 of the recess 64 is of a conical shape which extends upwardly and outwardly and has teeth 68 thereon which extend in a vertical direction. Sharp edges on these teeth face in a direction to resist lefthand rotation of lower pipe section 58 by digging into the conical shoulder 56.

Another alternative pipe ram, which is shown in FIG. 9 and designated in its entirety by reference character 70, also includes a body 71, which may be of the same shape and size as the body of the pipe ram 54, formed with a recess 72 in its inner end for fitting closely about a pipe section 28. Additionally, the body 71 carries seal means including portions 73 and 74 which, similarly to those of the ram 54, extend across the inner end, over the top and along the sides of such body. However, as distinguished from such other pipe rams, the ram 70 includes a one-way clutch 75 adjacent the recess 72 and thus in position to engage and resist lefthand rotation of the lower pipe section 58 supported thereon.

As best shown in FIGS. 10 and 11, the one-way clutch comprises a finger 76 pivotally mounted within a pocket 77 in the recess 72 above the cross seal 73. As shown in FIG. 11, the pocket 77 is of such shape in a horizontal direction that it permits the finger 76 to swing between the position shown, in which one side thereof is engaged against a wall 79 of the pocket and a sharp point on its inner end 78 extends into the recess, and another position (not shown) wherein the finger lies against the wall 80 of the socket with its inner end 78 withdrawn from the recess 72. Thus, when pipe section 58 is disposed in the recess 72, the finger grippingly engages shoulder 56 to resist its rotation in a lefthand direction, while permitting rotation in a righthand direction. As shown, the finger is urged against shoulder 79 and thus into a position for resisting lefthand rotation of the pipe section, by means of a coil spring 81 engaging it and a recess 82 in wall 80.

As shown in FIG. 10, the pocket 77 is also of such shape in a vertical direction as to permit the finger 76 to be moved vertically between limited positions engaging a top wall 83 and a bottom wall 84 of the socket. Normally, however, the finger is caused to assume an intermediate position, shown in FIG. 10, by means of coil springs 85 engaging its upper and lower surfaces and recesses formed in the top and bottom walls 83 and 84. In this manner, the finger is free to move downwardly, as shoulder 56 on the bottom section of the tool joint engages it, to an extent dependent on the amount of weight which the string imposes on the joint and thus on the pipe rams, and to move upwardly as the lower pipe section is raised, and thus to allow the pointed end 78 thereon to be moved out of a groove which it forms in the shoulder on the lower tool joint section.

The finger is pivotally mounted for such movement in both vertical and horizontal directions by means of a ball 86 on its inner end received within a correspondingly shaped socket 87 in the inner end of the pocket 77. The body of the ram includes a portion 88 removably connected to the remainder thereof and disposed above the pocket to provide the top wall 83 of the pocket 77, and thus releasably retain the finger and springs in the positions shown.

As shown in FIGS. 1 and 2, blind rams 90 are mounted within guideways 91 extending outwardly from the bore 22 of the housing 21. As in the case of the back-off and pipe rams, the blind rams 90 include bodies which are of a cross-sectional shape for fitting closely within the guideways 91 and thus for guidably sliding therein between positions removed from the bore 22, as shown in FIG. 1, and extended positions across the bore and engaging one another along their inner ends. The blind rams are caused to be moved between extended and retracted positions by means of operators 94, which, similarly to the operators 59 for the pipe rams, may be of the same type and construction as the operators 35 for the back-off rams. Seal means are carried by the bodies of the blind rams for sealing with respect to one another as well as with respect to the guideways 91 for closing off the bore of an open hole when moved into the latter position. Thus, as previously described, these rams are useful in closing off an open hole, either when a drill string or other pipe is not disposed therein, or after disconnection of the upper section of the drill string from the lower section thereof in the manner previously described. For this purpose, the seal means carried on the bodies of rams 90 includes portions 92 extending across the inner ends of the ram bodies, and portions 93 cooperating with the portions 92 and the guideways for closing off the bore in the manner previously described in connection with the pipe rams.

As shown in FIGS. 1 and 2, the guideways 91 for the blind rams extend at a right angle with respect to the guideways 31 for the back-off rams. In this manner, it is possible to place the two sets of guideways quite close together, thereby reducing the overall height of the body 21. In the particular embodiment of the invention illustrated, the guideways 55 for the pipe rams extend in directions parallel to the guideways for the blind rams, and thus at right angles to the guideways for the back-off rams.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the present invention without departing from the scope thereof, it is to be understood that all matter herein set forth or shown in the accompanying drawings is to be interpreted as illustrative and not in a limiting sense.

The invention having been described, what is claimed is:

1. Apparatus for disconnecting the lower threaded end of an upper section from the upper threaded end of a lower section of a pipe string which is held against movement within the bore of an underwater wellhead through which the strings extends, comprising a housing adapted to be connected as a part of the wellhead, said housing having a bore therethrough alignable with the bore of the wellhead to receive the ends of said sections, and guideways extending outwardly from the bore, and a ram guidably movable longitudinally within each guideway toward and away from the bore, each ram including means arranged to grippingly engage and move along a side of the end of the upper section, and thereby exert a force on said upper section tending to rotate it about its axis, as the ram is moved in one direction, and to be relieved from said gripping engagement, as the ram is moved in the opposite direction, whereby said ram may be returned to a position from which it may again be moved in said one direction for exerting force on said upper section.

2. Apparatus of the character defined in claim 1, wherein there are a pair of oppositely disposed guideways and rams.

3. Apparatus for disconnecting the lower threaded end of an upper section from the upper threaded end of the lower section of a pipe string extending through the bore of an underwater wellhead, comprising a housing adapted to be connected as a part of the wellhead, said housing having a bore therethrough alignable with the bore of the wellhead to receive the ends of said sections, and guideways extending outwardly from the bore, means in the housing for holding said lower section against movement within the bore, and a ram guidably movable longitudinally within each guideway toward and away from said upper section, each ram including means arranged to grippingly engage and move along a side of the end of the upper section, and thereby exert a force on said upper section tending to rotate it about its axis, as the ram is moved in one direction, and to be relieved from said gripping engagement, as the ram is moved in the opposite direction, whereby said ram may be returned to a position from which it may again be moved in said one direction for exerting force on said upper section.

4. Apparatus of the character defined in claim 3, wherein said housing has additional guideways extending outwardly from the bore thereof below the first-mentioned guideways, and said holding means includes additional rams each mounted in an additional guideway for movement toward and away from the bore and having a recess therein to fit tightly about a portion of said lower section.

5. Apparatus for disconnecting the lower threaded end of an upper section from the upper threaded end of a lower section of a pipe string which is held against movement within the bore of an underwater wellhead through which the string extends, comprising a housing adapted to be connected as a part of the wellhead, said housing having a bore therethrough alignable with the bore of the wellhead to receive the ends of said sections, and at least one guideway extending outwardly from the bore, and a ram in each guideway including a carrier guidably movable longitudinally therein toward and away from the bore, and a jaw mounted on the carrier for longitudinal movement therewith, said jaw having a cam surface which is slidably engageable with a cam surface on the jaw, and a toothed surface arranged to be wedged by said cam surfaces into gripping engagement with and movement along a side of the end of said upper section, and thereby exert a force on said upper section tending to rotate it about its axis, as the carrier is moved in one direction, and to be relieved from said gripping engagement, as the carrier is moved in the opposite direction, whereby said carrier may be returned to a position from which is may again be moved in said one direction for exerting force on said upper section.

6. Apparatus of the character defined in claim 5, including a spring engaging the jaw and carrier of each ram to urge the jaw to a position in which its toothed surface is so arranged.

7. Apparatus of the character defined in claim 5, wherein the toothed surface of the jaw is grippingly engageable with and movable along a side of the upper section during movement of the carrier in a direction toward said bore.

8. Apparatus for disconnecting the lower threaded end of an upper section from the upper threaded end of a lower section of a pipe string extending through the bore of an underwater wellhead, comprising a housing adapted to be connected as a part of the wellhead, said housing having a bore therethrough alignable with the bore of the wellhead to receive the ends of said sections, and at least one guideway extending outwardly from the bore, means in the housing for holding said lower section against movement within the bore, and a ram in each guideway including a carrier guidably movable longitudinally therein toward and away from the bore, and a jaw mounted on the carrier for longitudinal movement therewith, said jaw having a cam surface which is slidably engageable with a cam surface on the jaw, and a toothed surface arranged to be wedged by said cam surfaces into gripping engagement with and movement along a side of the end of said upper section, and thereby exert a force on said upper section tending to rotate it about its axis, as the carrier is moved in one direction, and to be relieved from said gripping engagement, as the carrier is moved in the opposite direction, whereby said carrier may be returned to a position from which it may again be moved in said one direction for exerting force on said upper section.

9. Apparatus of the character defined in claim 8, including a spring engaging the jaw and carrier of each ram to yieldably urge the jaw to a position in which its toothed surface is so arranged.

10. Apparatus of the character defined in claim 8, wherein said housing has additional guideways extending outwardly from the bore thereof below the first-mentioned guideway, and said holding means includes additional rams each mounted in an additional guideway for movement toward and away from the bore, and having a recess therein to fit tightly about a portion of said lower section.

11. For use in disconnecting the lower threaded end of an upper section from the upper threaded end of a lower section of a pipe string which is supported and held against rotation in a relatively fixed axial position within the bore of a housing connected as a part of an underwater wellhead, and with the upper section disposed opposite a guideway in the housing extending outwardly from the bore; apparatus comprising a ram including a carrier guidably movable londitudinally within the guideway toward and away from the bore, and a jaw mounted on the carrier for longitudinal movement therewith, said jaw having a cam surface which is slidably engageable with a cam surface on the jaw, and a toothed surface arranged to be wedged by said cam surfaces into gripping engagement with and movement along a side of the end of said upper section, and thereby exert a force on said upper section tending to rotate it about its axis, as the carrier is moved in one direction, and to be relieved from said gripping engagement, as the carrier is moved in the opposite direction, whereby said carrier may be returned to a position from which it may again be moved in said one direction for exerting force on said upper section.

12. Apparatus of the character defined in claim 11, including a spring engaging the jaw and carrier of each ram to yieldably urge the jaw to a position in which its toothed surface is so arranged.

13. Apparatus of the character defined in claim 11, wherein the cam surfaces on the jaw and carrier extend at an angle with respect to a plane perpendicular to the direction of movement of the carrier which is approximately equal to the friction angle between them.

14. Apparatus of the character defined in claim 11, wherein the toothed surface on the jaw extends at an angle to the direction of movement of the carrier, so that the cam surface on the jaw slides over the cam surface of the carrier as it moves along a side of said upper section.

15. A ram for use in rotating a cylindrical member about its axis, comprising a carrier guidably movable in a direction longitudinally within a guideway, a jaw mounted on the carrier for longitudinal movement therewith toward and away from the cylindrical member, said jaw having teeth on one substantially planar face thereof and extending substantially parallel to the axis of the member to provide surfaces thereon for tangentially engaging a side of said member, and a cam surface on an opposite face thereof guidably slidable over a cam surface on said carrier in a direction transverse to the direction of the teeth, so as to cause said teeth to move along the side of said member, and a spring between the jaw and carrier to urge the jaw in the opposite direction to a limited transverse position with respect to the carrier.

16. A ram of the character defined in claim 15, wherein said one face extends at an acute angle to the direction in which the carrier is moved.

17. A ram of the character defined in claim 15, wherein said carrier includes a rod extending parallel to said cam surfaces, and said jaw has a hole therethrough guidably slidable over the rod.

18. A ram of the character defined in claim 17, wherein the spring surrounds the rod.

19. A ram carrier, comprising a body adapted to guidably slide within a guideway in opposite longitudinal directions, said body having means on one end to which operating means may be attached, and a recess in its opposite end, the end wall of the recess having a cam surface extending thereacross, and the side walls of the recess having axially aligned holes to which a rod may be connected for extension along an axis parallel to said end wall, one of which is larger than the other and extends to the outer side of the body.

20. A ram carrier of the character defined in claim 19, wherein said cam surface extends at an angle to the direction of movement of the body.

21. A ram jaw, comprising a body having a top and a bottom, front and rear ends, and generally parallel opposite sides, the rear end of the body having a cam surface thereon which extends at an acute angle to one side of a plane perpendicular to the opposite sides of the body, and the front end of the body having a substantially planar face extending at an acute angle to the other side of said plane, and having teeth thereon which extend in a direction parallel to said side walls for use in tangentially engaging a side of a cylindrical member, said body also having means thereon attachable to a carrier for guiding it for relative movement with respect thereto in a direction parallel to said cam surface, so as to cause said teeth to move along the side of said cylindrical member and thereby rotate it about its axis.

22. A ram jaw of the character defined in claim 21, wherein said guiding means comprises a hole extending through the body from one side to the other along an axis parallel to the cam surface.

23. Apparatus for disconnecting the lower threaded end of an upper section from the upper threaded end of a lower section of a pipe string which is held against movement within a wellhead bore through which the string extends, comprising a housing adapted to be connected as a part of the wellhead, said housing having a bore therethrough to form a portion of the wellhead bore and to receive the ends of said sections, and a guideway extending outwardly from the bore, and a ram longitudinally reciprocable within the guideway, said ram including means for engaging the upper section, as the ram moves longitudinally within the guideway, and for exerting a force on said upper section tending to rotate it about its axis in response to further longitudinal movement of the ram within the guideway.

24. Apparatus of the character defined in claim 23, wherein said ram comprises a carrier guidably reciprocable within the guideway, and a jaw mounted on the carrier for longitudinal movement therewith, said jaw having a rough surface for so engaging the upper section, and means are provided for moving said jaw transversely of the carrier so as to cause said rough surface to move along a side of the upper section in response to said further longitudinal movement.

25. Apparatus of the character defined in claim 24, wherein said moving means comprises a cam surface forming an acute angle with respect to the rough surface and being slidably movable transversely over a cam surface of the carrier.

26. Apparatus of the character defined in claim 25, wherein the cam surfaces of the carrier and jaw form an angle with respect to the direction in which the ram is moved.

27. Apparatus for disconnecting the lower threaded end of an upper section from the upper threaded end of a lower section of a pipe string which is held against movement within a wellhead bore through which the string extends, comprising a housing adapted to be connected as a part of the wellhead, said housing having a bore therethrough to form a portion of the wellhead bore and to receive the ends of said sections, and a pair of oppositely disposed guideways extending outwardly from the bore, and a ram longitudinally reciprocable within each guideway, each ram including means for engaging the upper section as it moves longitudinally within the guideway, said means of at least one of the rams including means for exerting a force on said upper section tending to rotate it about its axis, in response to further longitudinal movement of said one ram within the guideway.

28. Apparatus of the character defined in claim 27, wherein the other of the rams also includes means for exerting a force on said upper section tending to rotate it about its axis, in response to further longitudinal movement of said other ram within the guideway.

29. Apparatus for disconnecting the lower threaded end of an upper section from the upper threaded end of a lower section of a pipe string which is held against movement within a wellhead bore through which the string extends, comprising a housing adapted to be connected as a part of the wellhead, said housing having a bore therethrough to form a portion of the wellhead bore and to receive the ends of said sections, and a plurality of guideways extending outwardly from the bore in circumferentially spaced relation, and a ram longitudinally reciprocable within each guideway, each ram including means for engaging the upper section, as it moves longitudinally within the guideway, and for exerting a force on said upper section tending to rotate it about its axis, in response to further longitudinal movement of the ram within the guideway.

30. Apparatus of the character defined in claim 29, wherein each ram comprises a carrier guidably reciprocable within the guideway, and a jaw mounted on the carrier for longitudinal movement therewith, said jaw having a rough surface for so engaging the upper section, and means are provided for moving said jaw transversely of the carrier so as to cause said rough surface to move along a side of the upper section in response to said further longitudinal movement.

31. Apparatus of the character defined in claim 30, wherein said moving means comprises a cam surface of the jaw forming an acute angle with respect to the rough surface and being slidably movable transversely over a cam surface of the carrier.

32. Apparatus of the character defined in claim 31, wherein the cam surfaces of the carrier and jaw of each ram form an angle with respect to the direction in which the ram is moved.

33. Apparatus for disconnecting the lower threaded end of an upper section from the upper threaded end of a lower section of a pipe string extending through a wellhead bore, comprising a housing adapted to be connected as a part of the wellhead, said housing having a bore therethrough to form a portion of the wellhead bore and to receive the ends of said sections, and a guideway extending outwardly from the bore, means in the housing for holding said lower section against movement, and a ram longitudinally reciprocable within the guideway, said ram including means for engaging the upper section, as the ram moves longitudinally within the guideway, and for exerting a force on said upper section tending to rotate it about its axis, in response to further longitudinal movement of the ram within the guideway.

34. Apparatus of the character defined in claim 33, wherein said housing had additional guideways extending outwardly from the bore thereof below the first-mentioned guideways, and said holding means includes additional rams each longitudinally reciprocable in one of said additional guideways and having a recess therein to fit about a portion of said lower section.

35. Apparatus for disconnecting the lower threaded end of an upper section from the upper threaded end of a lower section of a pipe string extending through a wellhead bore, comprising a housing adapted to be connected as a part of the wellhead, said housing having a bore therethrough to form a portion of the wellhead bore and to receive the ends of said sections, and a pair of oppositely disposed guideways extending outwardly from the bore, means in the housing for holding said lower section against movement, and a ram longitudinally reciprocable within each guideway, each ram including means for engaging the upper section as it moves longitudinally within the guideway, said means of at least one of the rams including means for exerting a force on said upper section tending to rotate it about its axis, in response to further longitudinal movement of one ram within the guideway.

36. Apparatus of the character defined in claim 35, wherein said housing has additional guideways extending outwardly from the bore thereof below the first-mentioned guideways, and said holding means includes additional rams each longitudinally reciprocable in one of said additional guideways and having a recess therein to fit about a portion of said lower section.

37. For use in disconnecting the lower threaded end of an upper section from the upper threaded end of a lower section of a pipe string which is supported and held against rotation in a relatively fixed axial position within the bore of a housing connected as a part of an underwater wellhead, and with the upper section disposed opposite a guideway in the housing extending outwardly from the bore; apparatus comprising a ram including a carrier slidably movable longitudinally within the guide-way toward and away from the bore, a jaw mounted on the carrier for longitudinal movement therewith, said jaw having a rough surface for engaging the upper section, in response to movement of the carrier longitudinally within the guideway, and means for moving said jaw transversely of the carrier so as to cause said rough surface to move along a side of said upper section in response to further longitudinal movement of the carrier within the guideway.

38. Apparatus of the character defined in claim 37, wherein said means comprises a cam surface of the jaw forming an acute angle with respect to the rough surface and slidably movable over a cam surface of the carrier so as to wedge said rough surface against said upper section.

39. Apparatus of the character defined in claim 38, including a spring engaging the jaw and carrier to yieldably urge the jaw to a position in which its rough surface is arranged to so engage the upper section.

40. Apparatus of the character defined in claim 38, wherein the rough surface of the jaw extends at an angle to the direction of movement of the carrier, so that the cam surface of the jaw slides over the cam surface of the carrier as it moves along a side of said upper section.

41. A ram jaw of the character defined in claim 22, wherein one end of the hole is counterboard.

* * * * *